US005606873A

United States Patent [19]

Zeller et al.

[11] Patent Number: 5,606,873

[45] Date of Patent: Mar. 4, 1997

[54] FINGER RING

[75] Inventors: Joseph Zeller, North Hills; Bruce Rubin, East Hills, both of N.Y.

[73] Assignee: Astoria Jewelry Mfg. Co., Inc., Long Island City, N.Y.

[21] Appl. No.: 480,368

[22] Filed: Jun. 7, 1995

[51] Int. Cl.[6] ..... A44C 9/00

[52] U.S. Cl. ..... 63/15; 63/15.6

[58] Field of Search ..... 63/15, 15.5, 15.6, 63/15.7, 26, 27, 28

[56] References Cited

U.S. PATENT DOCUMENTS

| | | | |
|---|---|---|---|
| 1,855,331 | 4/1932 | Bernier | 63/15 |
| 2,003,376 | 6/1935 | Lesmeister | 63/15 |
| 2,128,644 | 8/1938 | Gittler | 63/15 |
| 5,003,678 | 4/1991 | Oganesyan | 63/15 |

FOREIGN PATENT DOCUMENTS

| | | | |
|---|---|---|---|
| 535581 | 7/1930 | Germany | 63/15 |
| 2216389 | 10/1989 | United Kingdom | 63/15 |

*Primary Examiner*—Kien T. Nguyen
*Attorney, Agent, or Firm*—Graham & James LLP

[57] ABSTRACT

A finger ring structure, particularly for rings having precious stones set therein, which has improved placement and removal characteristics and with a more comfortable fit even when sized in accordance with measurements as used in the prior art. The ring comprises a standard section of a cylinder, with an inner surface and an outer surface, and is modified such that the circumferential edges of the inner surface are inwardly rounded and wherein the rounded edges of the inner surface, adjacent a setting or ornamental section are provided with a bombé configuration, i.e., an extended curved section, with a substantially arced inner surface configuration.

2 Claims, 3 Drawing Sheets

FIG. 1
(PRIOR ART)
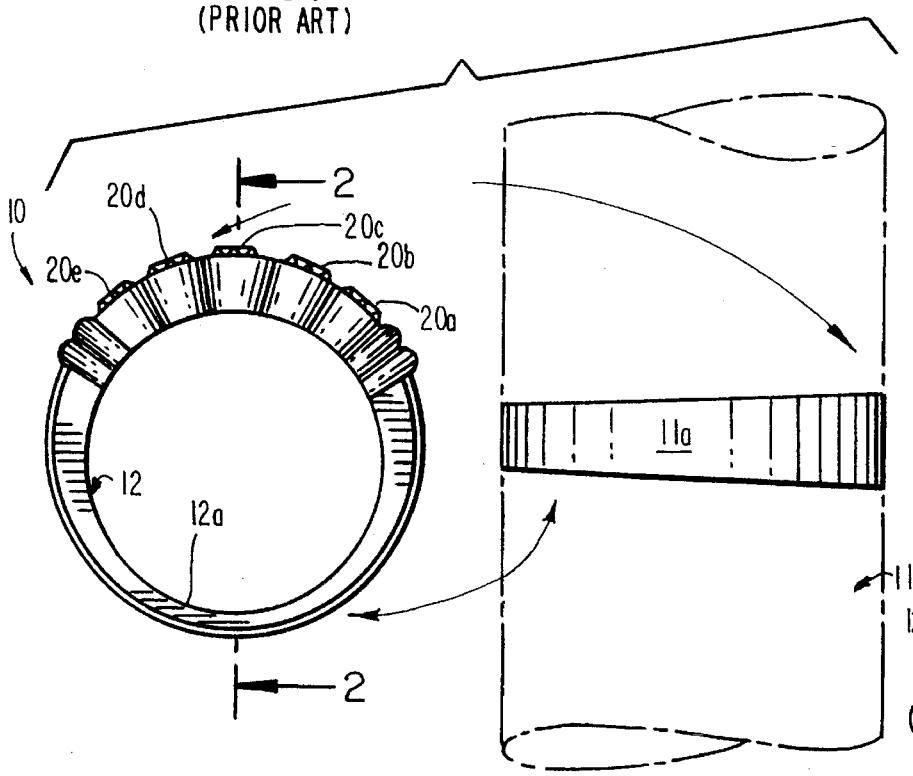
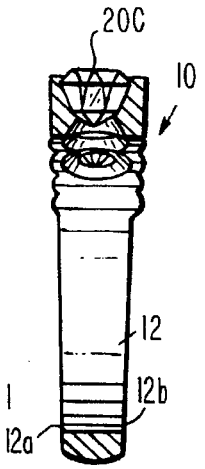
FIG. 2
(PRIOR ART)
FIG. 3
(PRIOR ART)
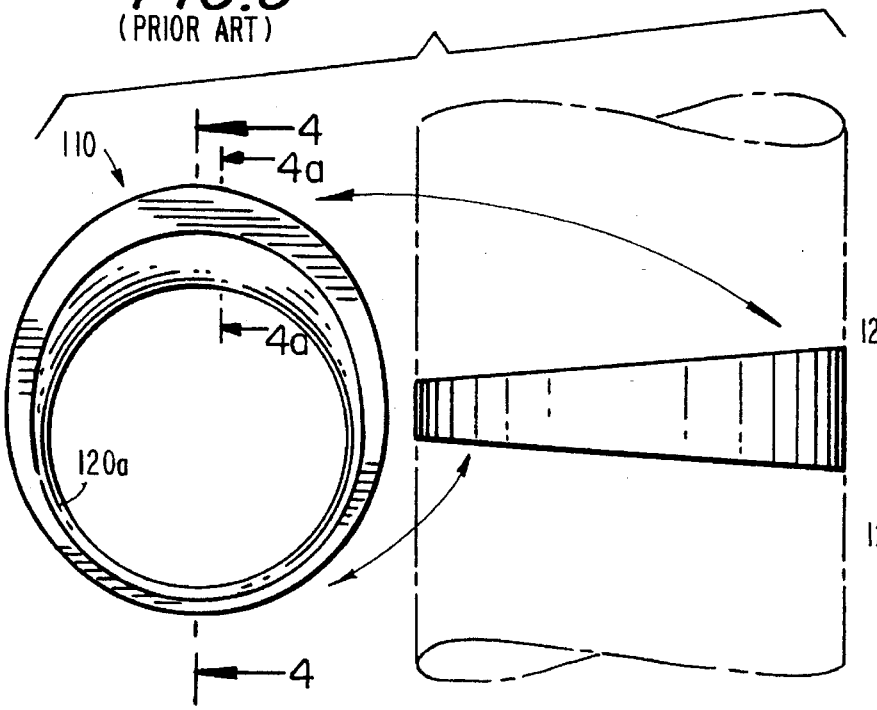
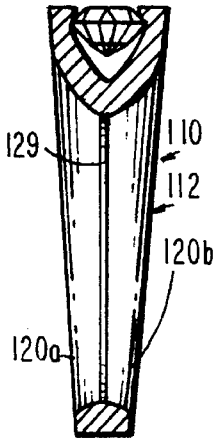
FIG. 4

FINGER RING

FIELD OF THE INVENTION

This invention relates to ornamental finger ring structures and particularly to rings having precious stones set thereon.

BACKGROUND OF THE INVENTION

Ornamental rings worn on fingers, such wedding bands, engagement rings and the like are made of precious metals such as gold, silver or platinum, and are configured to snugly fit onto fingers, with sized measurement. The interiors of these rings are generally shaped as cylinder sections, in order to conform with the finger on which it is placed. The exterior of the cylindrical section of a ring, which is positioned adjacent the palm of a wearer, is not otherwise ornamented, to avoid irritation of the hand and in any event, it is not normally as visible. The remaining portions of the ring (except for simple bands) are adorned with carvings, etchings, integrally molded on and soldered elements, set gems with settings, and the like.

The most expensive ring jewelry is provided with setting elements and precious stones such as diamonds set therein. Common setting elements included raised prongs which engage portions of the precious stones (e.g. the girdle of a commonly cut diamond) or channels formed in the band itself, with internal notches which engage the girdle or edges of the stone or stones. Clear glue or adhesive is used with inexpensive rings of a costume jewelry type, to hold ersatz stones in place. Rings with channels and internal notches for accommodation of precious gems, are generally made with the channels having open bases, in the ring metal beneath the set stones, to permit full light transmission through the stones to enhance brilliance thereof.

A problem with many, if not all snugly fitting rings is the fact that the finger on which the ring (having a circular cylindrical section configuration) is placed, does not actually have a fully co-fitting circular cross section). As a result, rings, even if properly sized, do not fit with a fully proper accommodation (though the soft flesh of the finger will accommodate to the circular ring). These rings are usually difficult, without lubrication, to put on or remove, particularly across the hard bony knuckle of the finger and with the high friction contact between the skin and the ring.

It is accordingly an object of the present invention to provide a ring structure which facilitates emplacement on and removal of the ring from a finger.

It is a further object of the present invention to provide such ring structure with a filled in base below channel set precious stones.

It is a still further object of the present invention to provide such ring structure which does not result in discomfort or irritation of adjacent fingers.

These and other objects, features and advantages of the present invention will become more evident from the following discussion and drawings in which:

SHORT DESCRIPTION OF THE DRAWINGS

FIG. 1 is a side view of a ring of the prior art, shown as taken from a section of a cylinder;

FIG. 2 is a cross section view of the ring of FIG. 1 taken along line 2—2;

FIG. 3 is a side view of a ring made in accordance with the present invention, shown as taken from a section of a cylinder;

Figure 5:
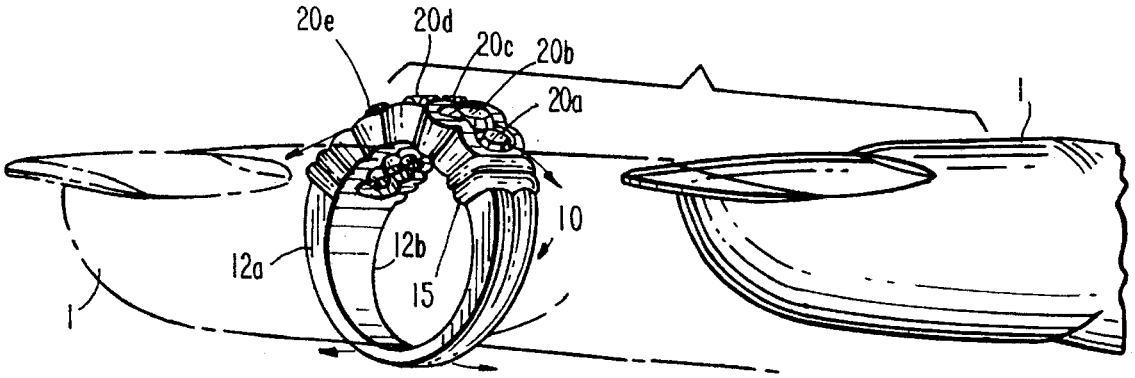
FIG.5 (PRIOR ART)
Figure 6:
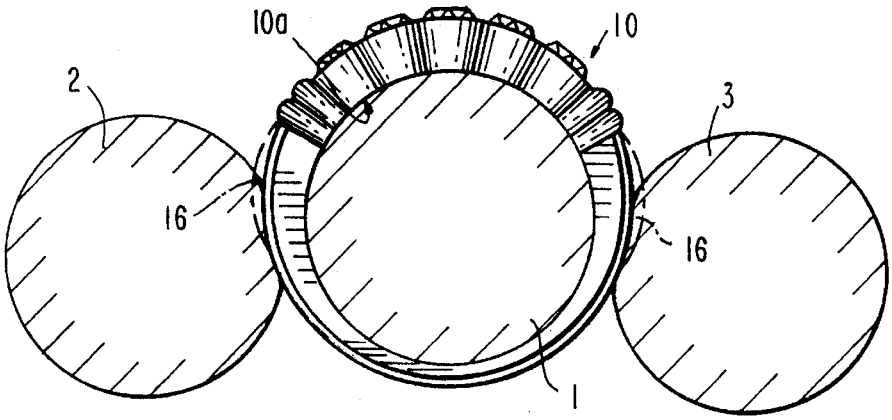
FIG.6 (PRIOR ART)
Figure 7:
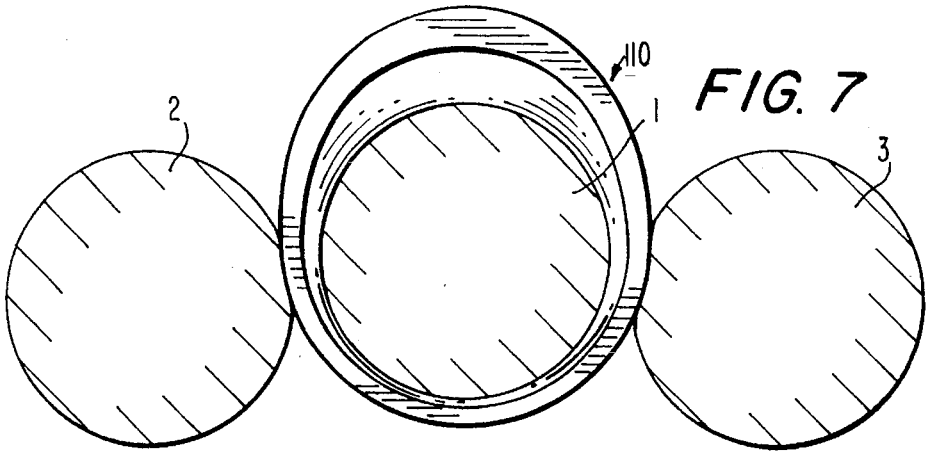
Figure 8:
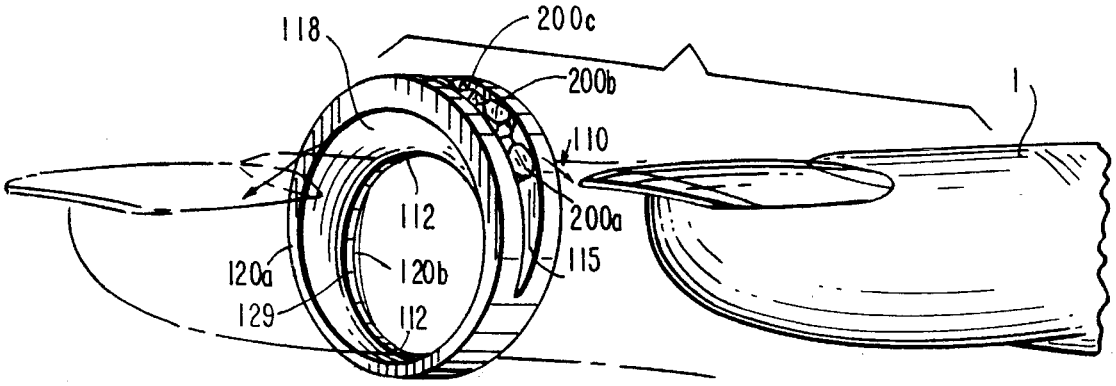
Figure 4A:
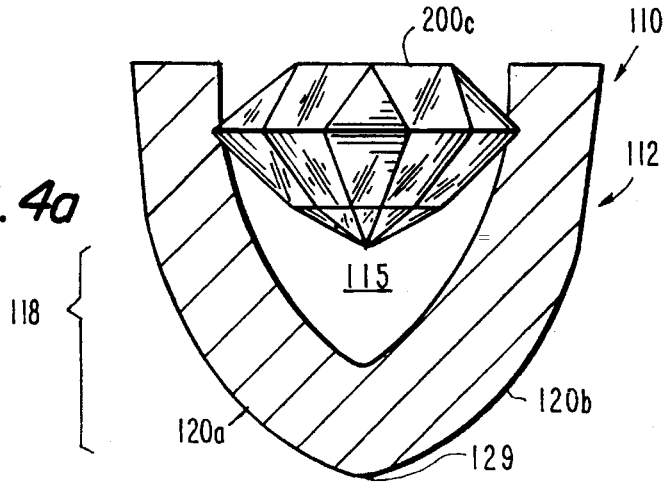
FIG. 4 is a cross section view of the ring of FIG. 3, taken along line 4—4.

FIG. 4*a* is an enlarged cross section view taken along line 4*a*—4*a* of FIG. 3;

FIG. 5 is an isometric view of the prior art ring of FIGS. 1 and 2, shown as being placed on (or taken off) a finger;

FIGS. 6 and 7 depict the rings of FIGS. 1 (prior art) and 3 (of the present invention), as positioned on fingers (shown in cross section); and FIG. 8 is an isometric view of the ring of the present invention of FIGS. 3 and 4, shown as being placed on (or taken off) a finger.

SUMMARY OF THE INVENTION

Generally the present invention comprises a ring structure, particularly for rings having precious stones set therein, which has improved placement and removal characteristics and with a more comfortable fit even when sized in accordance with measurements as used in the prior art. In accordance with the present invention, a ring, comprising a standard section of a cylinder, with an inner surface and an outer surface, is modified such that the circumferential edges of the inner surface are inwardly rounded and wherein the rounded edges of the inner surface, adjacent a setting or ornamental section are provided with a bombé configuration, i.e., an extended curved section, with a substantially arced inner surface configuration.

DETAILED DESCRIPTION OF THE INVENTION

In a preferred embodiment of a ring having a channel setting configuration for precious stones, the bombé is solid throughout, without the base apertures which are present in rings of the prior art.

While the edges of the inner surface of prior art rings have been radiussed to eliminate sharp edges, and gouging of fingers, they have not been inwardly curved. The introduction of curved edges in ring thicknesses, generally requires an increase in the ring thickness to accommodate the curve dimensions. However, increase of ring thickness is undesirable since it overly interferes with adjacent fingers and is either uncomfortable or irritating to the wearer. In accordance with the present invention, the edges of the inner surface of the ring in the areas adjacent the palm and the adjacent fingers are curved to a full radius, without increase of ring thickness, but with the curvature and thickness of the ring gradually increasing from the point at which the ring no longer touches or is proximate the adjacent finger(s) towards the ornamental portion or setting portion thereof, i.e., crown of the ring. The curvature increases, with a bombé configuration at the crown with a substantially complete arced inner surface of ring at such portion. With the edges of the inner surface of the ring being fully curved, as described, the ring, with the same internal diameter as a prior art ring, literally rolls on or off the finger.

The thickened bombé configuration also permits channel placement shown by the arrows, to facilitate placement or removal, is limited because of the edges 12*a* and 12*b*, which are very close to the finger.

Ring 110 of the present invention shown in FIGS. 3, 4, 4*a* 7 and 8, has an inner surface 112, with a smallest diameter being the same diameter as that of prior art ring 10 (i.e., same ring size), but with inner surface edges 120*a* and 120*b* being curved away from an inserted finger, as seen in FIGS. 4 and 8. Only segment 129 remains as a circumferential flat surface. Thus, with reference to FIG. 8, only a small area of the inner surface of the ring 110 is in frictional contact with finger 1. Furthermore, tilting of the ring 110, with placement and removal on and from the finger, causes the curved edges 120*a* and 120*b* of the ring 110 and bombé portion 118 to engage and roll across the skin of the finger 1.

In a further comparison between the prior art ring 10 of FIGS. 1, 2, 5 and 6 and the ring 110 of the present invention, shown in FIGS. 3, 4,4*a* 7 and 8, it is noted that adding an inner curvature to ring 10 at the setting area 10*a*, without the bombé configuration of the present invention, results in a limitation of space for insertion of stones 20*a–e*, in the channel 15 (i.e., the channel is narrowed). As a result, in order to set the stones 20*a–e*, it is necessary to add additional width 16 (shown in dotted lines) to properly accommodate the stones 20*a–e*, which of stones while maintaining a full inner surface curvature. Prior art rings cannot be radiussed adjacent the stone settings without unsightly deformation of the stone setting area or without sufficient setting room, absent excessive lateral extension which interferes with adjacent fingers. Furthermore, such prior art rings are made with bottom apertures in the channels whereby such bombé formation is not. It has however been discovered that closure of the base, with bombé formation does not affect perceived brilliance as compared to rings of the prior art.

For ring measurement purposes it is preferred that a small centrally positioned circumferential portion of the inner surface of the ring remains flat.

DESCRIPTION OF THE DRAWINGS AND THE PREFERRED EMBODIMENT

With reference to the drawings, in FIG. 1, a typical prior art ring 10 is shown as a section 11*a* of a cylinder 11 (shown in dotted lines). The circular inner surface 12 of the ring 10 has relatively sharp edges 12*a* and 12*b* and is essentially flat in cross section as shown in FIG. 2. When ring 10 is placed on or removed from a finger 1 (as shown in FIG. 5) there is a large area of frictional contact between the inner surface 12 and the finger 1, which makes movement up and down the finger (for placement and removal) difficult. Tilting of the ring 10, as increased width would interfere with adjacent fingers 2 and 3.

With the bombé configuration 118 in the ring 110 of the present invention, additional space is provided for the insertion of stones 200*a–e* into channel 115, which has had its dimensions increased for such accommodation but in a direction which will not interfere with adjacent fingers 2 and 3, as shown in FIG. 7.

It is understood that the above description and drawings are illustrative of the present invention and that changes may be made in the ring structure, ornamentation and materials without departing from the scope of the present invention, as deined in the following claims.

What is claimed is:

1. A finger ring structure, which has improved placement and removal characteristics, comprising a standard section of a cylinder having an inner surface, and with an ornamental external section thereof, the ornamental section comprising a channel into which stones are inserted and wherein said inner surface is continuous, whereby said channel has a closed base formed by the inner surface, said ring having an outer surface, each of the inner surface and outer surface having respective circumferential edges, wherein the circumferential edges of the inner surface are inwardly rounded and wherein the rounded edges of the inner surface, adjacent the ornamental section, are formed into a bombé configuration.

2. The finger ring of claim 1, wherein said bombé configuration is positioned on said ring, extending from an interior aperture of the ring for accommodation of a finger therein, in an upward and outward direction, relative to the aperture and finger accommodated therein, whereby the bombé configuration extends away from the outside of the finger and away from the adjacent juxtaposition of said finger with adjacent one or more fingers.

* * * * *